US007922318B2

(12) United States Patent
Hoshino

(10) Patent No.: US 7,922,318 B2
(45) Date of Patent: Apr. 12, 2011

(54) INKJET RECORDING APPARATUS

(75) Inventor: Yoshihide Hoshino, Tokyo (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 872 days.

(21) Appl. No.: 11/681,318

(22) Filed: Mar. 2, 2007

(65) Prior Publication Data

US 2007/0206083 A1 Sep. 6, 2007

(30) Foreign Application Priority Data

Mar. 6, 2006 (JP) ..... 2006-059110

(51) Int. Cl.
*B41J 2/01* (2006.01)

(52) U.S. Cl. ..... 347/102

(58) Field of Classification Search ..... 347/102
See application file for complete search history.

(56) References Cited

U.S. PATENT DOCUMENTS 5,510,822 A * 4/1996 Vincent et al. ..... 347/102
5,784,090 A * 7/1998 Selensky et al. ..... 347/102

FOREIGN PATENT DOCUMENTS

JP 2001310454 11/2001
JP 2003159791 6/2003
JP 2004-091151 3/2004
JP 2004-188659 7/2004

* cited by examiner

*Primary Examiner* — Julian D Huffman
(74) *Attorney, Agent, or Firm* — Lucas & Mercanti, LLP

(57) ABSTRACT

An inkjet recording apparatus, includes: recording head having nozzles that jet ink onto recording medium, wherein ink is cured by irradiating active energy ray and/or applying thermal energy; ink curing device for curing ink jetted onto recording medium, having an active energy ray irradiating unit and/or thermal energy applying unit; and controller that performs image recording by repeating a recording process plural times to form a single band in which process the recording head jets ink and then the active energy ray irradiation and/or thermal energy application is performed. Herein the controller controls the active energy ray irradiating unit and/or thermal energy applying unit such as to change at least one of operating parameters being an active energy ray irradiation amount, active energy ray irradiation timing, and thermal energy application amount, at least a first time and a last time of the repeated times of the recording process.

10 Claims, 7 Drawing Sheets

FIG. 6 ( a )
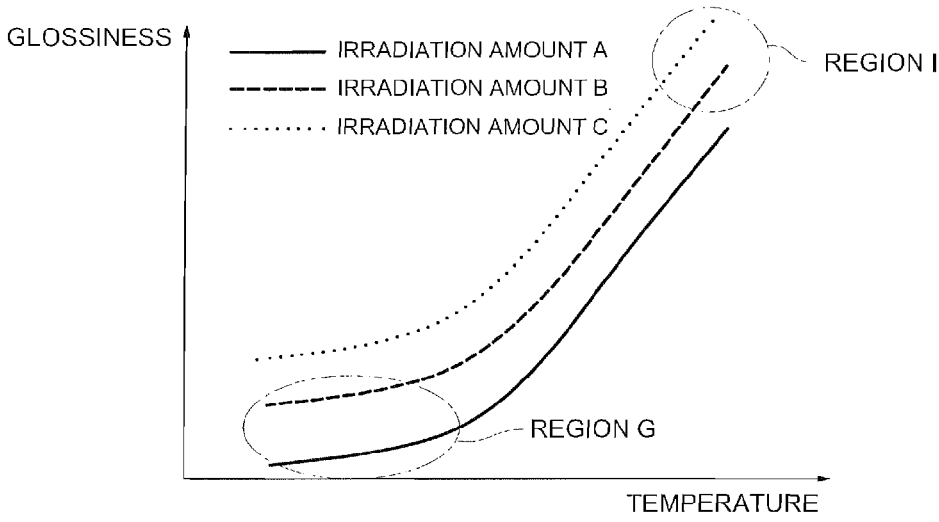
FIG. 6 ( b )
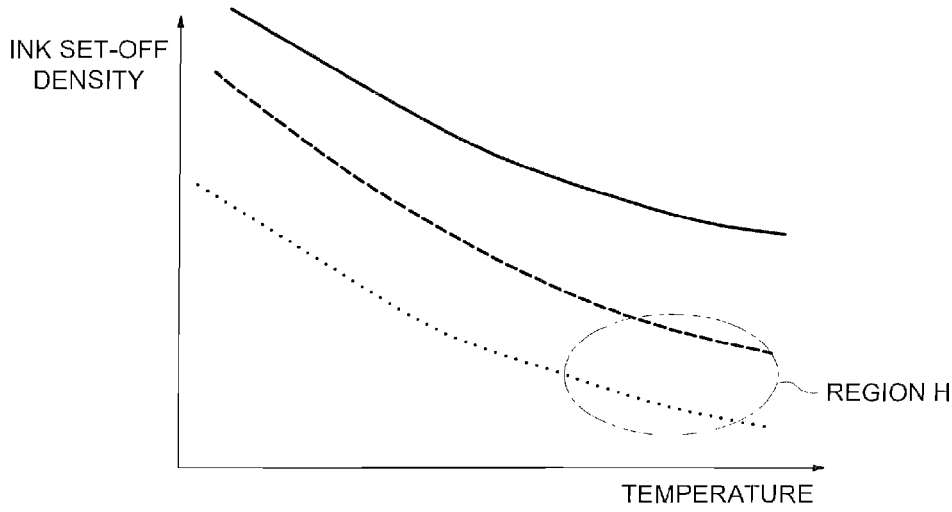

INKJET RECORDING APPARATUS

This application is based on Japanese Patent Application No. 2006-059110 filed on Mar. 6, 2006, in Japanese Patent Office, the entire content of which is hereby incorporated by reference.

FIELD OF THE INVENTION

The present invention relates to an inkjet recording apparatus, and particularly relates to an inkjet recording apparatus that preforms image recording by the use of ink curable by irradiating active energy ray or applying thermal energy.

BACKGROUND OF THE INVENTION

In general, as recording apparatuses that can flexibly meet with the demands of a small quantity and wide variety, there are known inkjet type recording apparatuses (hereinafter referred to as "inkjet recording apparatus") in prior arts. An inkjet recording apparatus records an image on a recording medium by jetting ink from nozzles provided at the surface, of a recording head, facing the recording medium so that the ink lands on the recording medium, and fixing the ink on it. An inkjet printing apparatus is characterized in that it easily and quickly meets the demand of small quantity because no plate making process is required, making a difference from a gravure printing type and flexo printing type. Further, an inkjet printing apparatus is advantageous in that it makes little noise and can easily perform color image recording, using inks in many colors.

Further, in recent years, as an inkjet recording apparatus applicable to various recording media, there is known an inkjet recording apparatus that uses photo curable ink containing a photo initiator having a predetermined sensitivity to light, such as UV-ray, and irradiates light on ink having landed on a recording medium so as to cure and fix the ink on the recording medium (for example, see Patent Document 1: Japanese Patent Publication TOKKAI No. 2001-310454). With an inkjet recording apparatus that performs recording by the use of ink curable by irradiation of active energy ray, such as the above-described inkjet recording apparatus that uses photo-curable ink, ink is instantly cured by irradiation of active energy ray, and accordingly, little ink penetrates into a recording medium or blurs, which makes it possible to perform image recording even on recording media, such as films including resin without an ink receiving layer nor ink absorbency, metals, etc., as well as plain paper.

However, even when such an inkjet recording apparatus is used to perform recording, ink tends to penetrate into a recording medium that has high ink absorbency.

In this situation, there is offered an inkjet recording apparatus that changes the light irradiation amount, depending on the ink penetration amount into a recording medium in order to prevent penetration of ink into the recording medium (see Patent Document 2: Japanese Patent No. 3549159). With this inkjet recording apparatus, the light irradiation amount is increased for a recording medium with a large ink penetration amount so as to prevent penetration of ink into the recording medium.

On the other hand, as inkjet recording apparatuses of an active energy ray irradiation type, there are offered an apparatus that adjusts the temperature of a recording medium, depending on the external environment (see Patent Document 3: Japanese Patent Publication TOKKAI No. 2004-91151) and an apparatus that adjusts the irradiation amount or the irradiation timing of the energy ray, depending on a recording medium (see Patent Document 4: Japanese Patent Publication TOKKAI No. 2004-188659).

Regarding Patent Document 3 and Patent Document 4, the temperature of a recording medium, the irradiation amount or the irradiation timing of an active energy ray is adjusted, depending on external environment or the recording medium. However, the penetration amount of ink into the recording medium is not taken into account, and the effect on prevention of penetration of ink into a recording medium is insufficient.

On the other hand, regarding Patent Document 2, the ink penetration amount is taken into account, and the ink penetration amount into a recoding medium is adjusted by adjusting the light irradiation amount. However, if the light irradiation amount is increased, the quality of a recording image finally obtained may be degraded, depending on the recording medium. For example, glossiness may be lost, or an image may become coarse.

In the present invention, problems, as described above, are taken into account, and while penetration of ink into a recording medium is prevented, degradation of the quality of a recorded image is prevented. An object of the invention is to provide an inkjet recording apparatus that achieves precise image recording in such a manner.

SUMMARY OF THE INVENTION

To solve a problem, as described above, in an aspect of the invention, there is provided an inkjet recording apparatus, including:

a recording head having a plurality of nozzles that jet ink onto a recording medium, wherein the ink is cured by irradiating active energy ray thereon and/or applying thermal energy thereto;

an ink curing device for curing the ink jetted onto the recording medium, having an active energy ray irradiating unit and/or thermal energy applying unit; and a controller that performs image recording by repeating a recording process for plural times to form a single band in which process the recording head jets ink onto the recording medium and then the active energy ray irradiation and/or thermal energy application is performed, wherein the controller controls the active energy ray irradiating unit and/or thermal energy applying unit such as to change at least one of operating parameters which are an active energy ray irradiation amount, active energy ray irradiation timing, and thermal energy application amount, at least a first time and a last time of the repeated times of the recording process.

BRIEF DESCRIPTION OF THE DRAWINGS

FIG. 6*a* is a diagram showing the relationship between the glossiness of an image surface on a recording medium, and the temperature and UV irradiation amount, and FIG. 6*b* is a diagram showing the relationship between the color transfer to the back side of an image through a recording medium, and the temperature and UV irradiation amount;

DETAIL DESCRIPTION OF THE PREFERRED EMBODIMENTS

Figure 1:
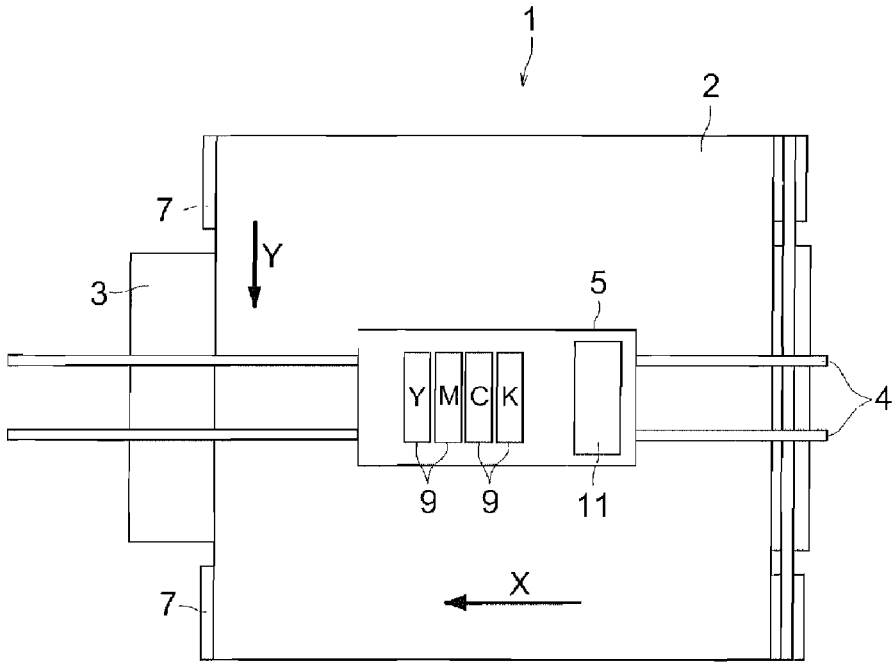
FIG. 1 is a top view showing a structure of a main part of an inkjet recording apparatus in a first embodiment of the present invention.

The present invention includes the following structures.

(Item 1)

An inkjet recording apparatus, including:

a recording head having a plurality of nozzles that jets ink onto a recording medium, wherein the ink is cured by irradiating active energy ray thereon and/or applying thermal energy thereto;

an ink curing device for curing the ink jetted onto the recording medium, having an active energy ray irradiating unit and/or thermal energy applying unit; and a controller that performs image recording by repeating a recording process for plural times to form a single band in which process the recording head jets ink onto the recording medium and then the energy ray irradiation and/or thermal energy application is performed, wherein the controller controls the active energy ray irradiating unit and/or thermal energy applying unit such as to change at least one of operating parameters which are an active energy ray irradiation amount, active energy ray irradiation timing, and thermal energy application amount, at least making a difference between a first time and a last time of the repeated times of the recording process.

According to above Item 1, recording quality on the top image layer and the bottom image layer in an image on a recording medium can be adjusted. Accordingly, the recording quality including glossiness and the size of dots can be adjusted while adjusting penetration of ink, thereby enabling adjustment of the image quality in both aspects. Further, by optimizing the active energy ray irradiation amount and/or the heat energy application amount respectively for each recording process, power consumption and damage caused by active energy ray irradiation onto a recording medium can be reduced, compared with devices in prior arts having a structure in which these operating parameters are not adjusted for each recording process.

(Item 2)

The inkjet recording apparatus of Item 1, further including a moving mechanism that relatively moves the recording head and the recording medium, wherein the controller divides a nozzle area, the nozzles being arranged in the nozzle area, into a number of times of scanning necessary to form a single band, and controls the recording head to scan for the number of times dividing the nozzle area, so as to form a single band.

According to Item 2, even when performing image recording with a so-called serial type inkjet recording device, similar effects as in the case of Item 1 can be attained. In other words, even with a structure where recording heads and active energy ray irradiation units are not arranged in a large number, a similar effects as in the case of Item 1 can be achieved.

(Item 3)

The inkjet recording apparatus of Item 1 or 2, wherein the controller changes at least one of the active energy ray irradiation amount, active energy ray irradiation timing, and thermal energy application amount, corresponding to a sort of the recording medium.

According to Item 3, recording quality including penetration of ink, glossiness, and size of dots can be adjusted, for various kinds of recording media with different ink penetration amount.

(Item 4)

The inkjet recording apparatus of any one of Items 1 to 3, wherein the controller changes at least one of the active energy ray irradiation amount, active energy ray irradiation timing, and thermal energy application amount, so as to adjust a penetration amount of ink on the recording medium.

According to Item 4, the ink penetration amount into a recording medium can be adjusted, corresponding to the ink penetration amount which depends on the recording medium and environment.

(Item 5)

The inkjet recording apparatus of any one of Items 1 to 4, wherein the controller changes at least one of the active energy ray irradiation amount, active energy ray irradiation timing, and thermal energy application amount, so as to adjust a size of a dot on the recording medium.

According to Item 5, the size of dots can be adjusted for ink on the top layer, which varies with environment.

(Item 6)

The inkjet recording apparatus of any one of Items 1 to 5, wherein the controller changes at least one of the active energy ray irradiation amount, active energy ray irradiation timing, and thermal energy application amount, so as to adjust glossiness of ink on the recording medium.

According to Item 6, it is possible to adjust glossiness of an image, which varies with environment.

(Item 7)

The inkjet recording apparatus of any one of Items 1 to 6, wherein the ink curing device has a plurality of the active energy ray irradiating units;

and wherein the controller adjusts the active energy ray irradiation amount, by controlling an active energy ray irradiation amount to be irradiated from each active energy ray irradiating unit and/or a number of the active energy ray irradiating units to be used.

According to Item 7, the active energy ray irradiation amount can be adjusted by a simple method.

(Item 8)

The inkjet recording apparatus of any one of Items 1 to 6, wherein a shielding member for shielding active energy ray irradiated onto the recording medium is provided between the active energy ray irradiating unit and the recording medium;

and wherein the controller adjusts the active energy ray irradiation timing, corresponding to a range shielded by the shielding member.

According to Item 8, the active energy ray irradiation amount and/or irradiation timing can be adjusted by a simple method.

(Item 9)

The inkjet recording apparatus of any one of Items 1 to 6, further including a platen that supports the recording medium during recording, wherein the thermal energy applying unit is provided with a plurality of heaters on the platen;

and wherein the controller adjusts the thermal energy application amount, corresponding to a density of the plurality of heaters.

According to Item 9, the thermal energy application amount can be adjusted by a simple method.

(Item 10)

The inkjet recording apparatus of any one of Items 1 to 9, wherein when the controller forms a single band through n times of the recording process, the controller performs control to make the active energy ray irradiation amount and/or the thermal energy application amount to be larger in the first recording process than in the $n^{th}$ recording process.

According to Item 10, ink that first lands on a recording medium contributes most to ink penetration into the recording medium, and ink penetration can be inhibited by setting a large active energy ray irradiation amount and/or thermal energy application amount for the ink.

(Item 11)

The inkjet recording apparatus of any one of Items 1 to 9, wherein when the controller forms a single band through n times of the recording process, the controller performs control to decrease the active energy ray irradiation amount and/or thermal energy application amount as the recording process is repeated.

According to Item 11, in performing image recording through recording process repeated plural times, ink penetration can be inhibited by setting a large active energy ray irradiation amount and/or thermal energy application amount for ink that lands on a recording medium, at the earlier times of executing the recoding process that significantly effects on ink penetration.

First Embodiment

An inkjet recording apparatus in a first embodiment in accordance with the present invention will be described below, referring to FIGS. 1 to 6*b*.

First, as shown in FIG. 1, an inkjet recording apparatus 1 in the present embodiment is a serial print type. This inkjet recording apparatus 1 is provided with a platen 3 which is formed in a flat plate to support a recording medium 2 on the non-recording side.

Guide rails 4 in a rod shape extending in the lateral direction of the recording medium 2 are provided above the platen 3. A carriage 5 is supported on the guide rails 4, and is reciprocally movable, driven by a carriage driving mechanism 6 (refer to FIG. 3) as a head scanning unit, along the guide rails 4 in the lateral direction of the recording medium 2 (hereinafter referred to as "main scanning direction X").

Further, the inkjet recording apparatus is provided with a recording medium conveying mechanism 8 (refer to FIG. 3) having plural conveying rollers 7 and the like to convey a recording medium 2 in a sub-scanning direction Y perpendicular to the main scanning direction X. The recording medium conveying mechanism 8 rotates the conveying rollers 7, and thereby repeats conveying and stopping the recording medium 2 in a synchronization with the motion of the carriage 5 during image recording, thus conveying the recording medium 2 intermittently from the upstream side to the downstream side along the sub-scanning direction Y.

As shown in FIG. 1, on the carriage 5, there are mounted four recording heads 9 corresponding to respective colors (black (K), cyan (C), magenta (M), and yellow (Y)) used by the inkjet recording apparatus 1 in the present embodiment. The outer shape of the respective recording heads 9 is substantially a rectangular solid, and the recording heads are disposed parallel to each other with respect to the longitudinal direction. Inks to be used by the inkjet recording apparatus 1 are not limited to these. For example, it is possible to use color inks, such as light yellow (LY), light magenta (LM), and light cyan (LC), and also transparent ink and the like. Recording heads 9 corresponding to the respective inks are mounted on the carriage 5.

Figure 2:
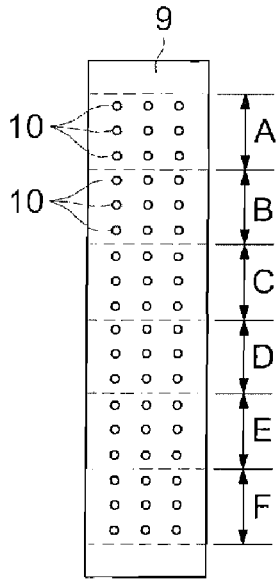
FIG. 2 is a diagram showing the respective nozzle areas of a recording head of the inkjet recording apparatus in the first embodiment.

The surface, of a recording head 9, facing the recording medium 2 is, for example as shown in FIG. 2, an ink jetting surface at which plural nozzles 10 are formed in an array along the longitudinal direction of the recording head 9, wherein the recording head 9 jets ink from the respective nozzles 10. In the present embodiment, the inkjet recording apparatus 1 performs recording on each one band by scanning in six times, as later described. An area where nozzles 10 are arranged (hereinafter referred to as "nozzle area") is, as shown in FIG. 2 for example, divided into six areas from nozzle area A to nozzle area F along the longitudinal direction of the recording head 9. A later described control section 13 (refer to FIG. 3) respectively controls ink jetting from the respective nozzle areas.

In the carriage 5 and on the upstream side in the traveling direction of the carriage 5 (direction of arrow X in FIG. 1) in the course of image recording, there is arranged UV irradiation device 11 as an irradiation device that irradiates UV as an active energy ray that cures and fixes ink that is jetted and impacted on recording medium 2.

Figure 4:
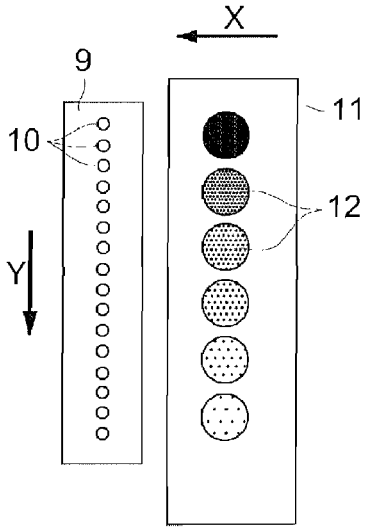
FIG. 4 is a diagram showing a structure of a light source of a UV irradiation device of the inkjet recording apparatus in the first embodiment.

As shown in FIG. 4, UV irradiation device 11 is provided with a plurality of LEDs (Light Emitting Diode) 12 which are arranged in the direction of a row of nozzles as a UV light source, and each LED 12 is structured so that it irradiates ink on recording medium 2 with UV, corresponding respectively to nozzle regions A-F. Incidentally, in addition to LED 12, the UV light source can employ, for example, a high-pressure mercury lamp, a low-pressure mercury lamp, a metal halide lamp, a semiconductor laser, a cold-cathode tube, and an excimer lamp, to which, however, the invention is not limited.

Further, an arrangement of the UV irradiation device 11 is not limited to the foregoing, and UV irradiation devices 11 may also be provided between recording heads 9 respectively. In addition, the UV irradiation devices 11 may also be provided outside the carriage 5, without being limited to the occasion where the UV irradiation devices 11 is mounted on the carriage 5.

Now, ink used in the present embodiment will be explained as follows.

Ink used in the present embodiment is UV curing ink having properties to become cured when it is irradiated with a UV that represents an active energy ray, and it contains, at least, polymerizable compounds (including heretofore known polymerizable compounds), photo-initiators and coloring materials as major components. The aforesaid photo-curable ink is divided roughly into radical polymerization type ink containing radical polymerizable compounds as a polymerizable compound and cation polymerization type ink containing cation polymerizing compounds, and ink of the aforesaid both types can be applied as ink used in the present embodiment. Further, ink of a hybrid type wherein radical polymerization type ink and cation polymerization type ink are combined can be applied as ink used for the present embodiment. However, it is preferable to use the cation polymerization type ink in particular, because the cation polymerization type ink having less or no inhibitory effect on polymerization reaction by oxygen is more excellent in functionality and general versatility. The cation polymerization type ink is a mixture containing, at least, cation polymerizable compounds such as oxetane compounds, epoxy compounds and vinyl ether compounds, photo-cation-initiators and coloring materials.

Further, recording media 2 made of various types of materials respectively such as various types of paper including plain paper, recycled paper, glossy paper, various types of textiles, various types of non-woven fabrics, resins, metals and glasses can be applied.

Next, a schematic control structure of the inkjet recording apparatus 1 in the present embodiment will be explained, referring to FIGS. 3, 5 and 6.

Figure 3:
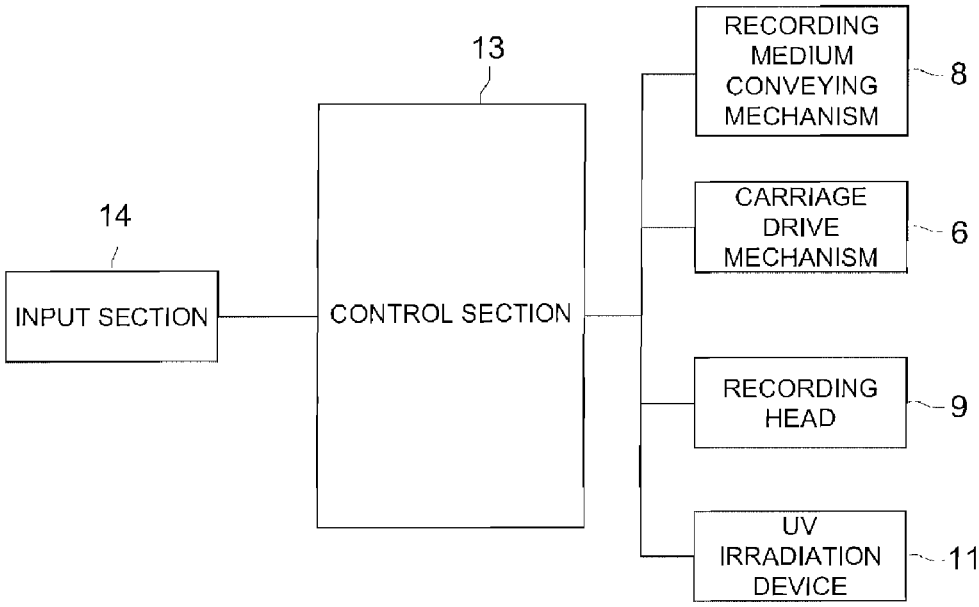
FIG. 3 is a block diagram showing a schematic control structure of the inkjet recording apparatus in the first embodiment.

As shown in FIG. 3, the inkjet recording apparatus 1 is provided with control section 13 that is structured to have, for example, CPU (Central Processing Unit), ROM (Read Only Memory) storing therein various types of control programs, and RAM (Random Access Memory) that stores image data temporarily (none of them is illustrated). The control section 13 loads control programs recorded on ROM on a working area of RAM so that the control programs are executed by CPU.

Further, the inkjet recording apparatus 1 has inputting section 14 where types of recording media 2 and image recording conditions are inputted, and information inputted through input section 14 is sent to control section 13. The input section 14 is a keyboard and an operation panel, for example, and a user can select and establish a type of recording medium 2 used for image recording, and to select and establish various types of image recording conditions including a desired image recording speed and resolution.

Further, the control section 13 controls carriage drive mechanism 6 to let carriage 5 to reciprocally scan in the main scanning direction X, and controls operations of recording medium conveyance mechanism 8 to convey recording medium 2 intermittently in the sub-scanning direction Y in synchronization with operations of carriage 5.

Further, image data concerning recording images are sent to the control section 13 from an unillustrated outer equipment, and the control section 13 causes recording head 9 to operate, based on the image data thus sent to it and on information inputted from input section 14. Due to this, ink in an appropriate amount of jetting is jetted from each recording head 9, so that a certain image is recorded on recording medium 2.

Figure 5:
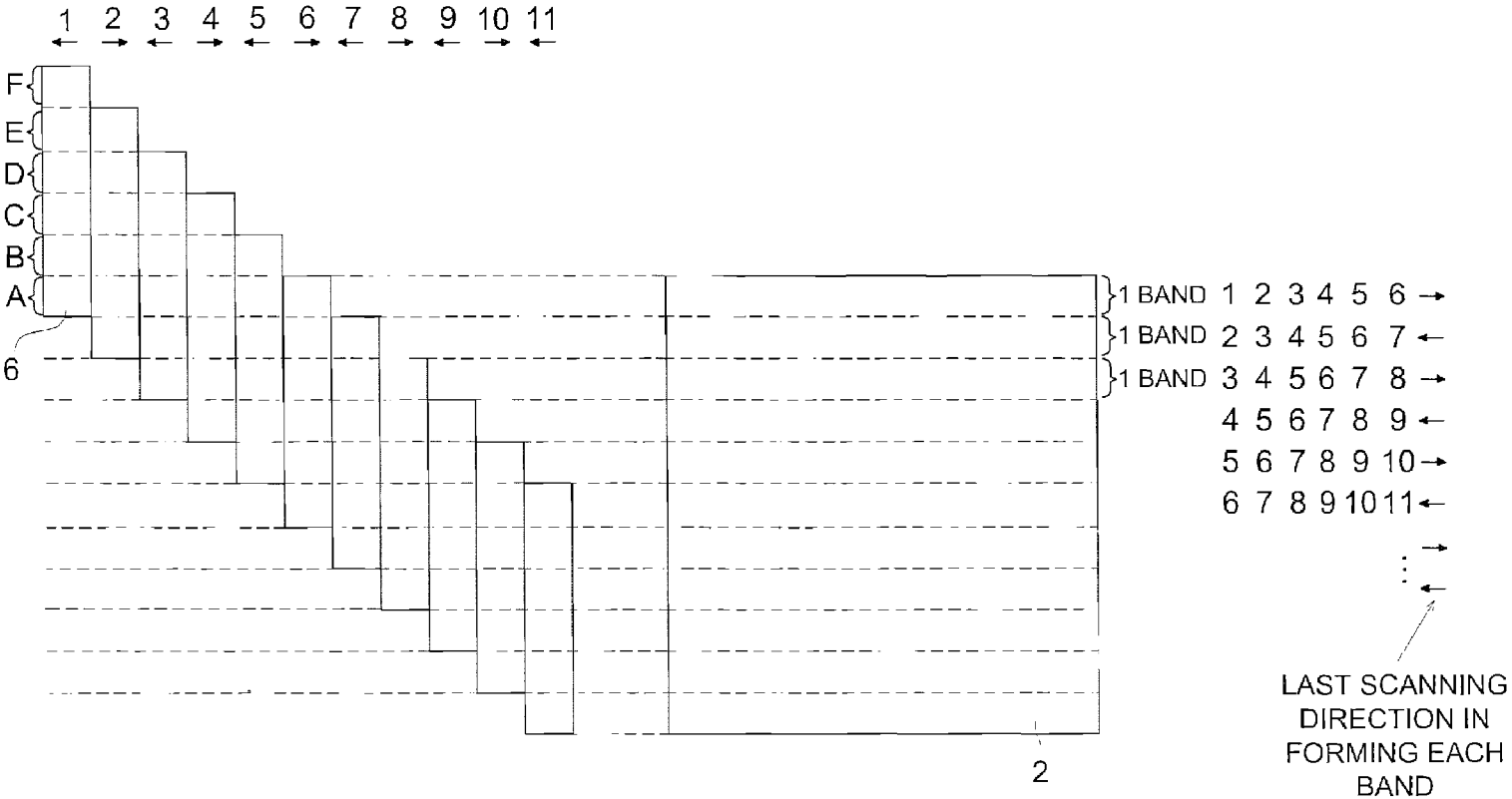
FIG. 5 is a diagram of a case of performing normal recording, showing the nozzle areas, of a recording head, that record respective bands, and showing scanning directions of the carriage in the last scanning process in forming the respective bands.

In the present embodiment, when a feeding pitch of recording medium 2 conveyed by a single conveyance is set to be one band, as shown in FIG. 5, the inkjet recording apparatus 1 is arranged such that image recording is conducted by scanning one band with reciprocal motion of the carriage 5 in 6 times and jetting ink during scanning in the forward direction along direction X. For example, for the uppermost band of recording medium 2 in FIG. 5, the first scanning is carried out in the main scanning direction X, and image recording for the first scanning is conducted by jetting ink from nozzles 10 located at one end (nozzle area A) of recording head 9. With the backward motion (opposite to direction X), the carriage 5 returns to the home position, through which ink is not jetted. Further, through the forward motion of the second reciprocal motion of the carriage 5, image recording for the second main scanning in direction X is carried out by jetting ink from nozzles 10 located at nozzle area B among nozzles 10 of recording head 9. Furthermore, through the forward motion of the third reciprocal motion of the carriage 5, image recording for the third main scanning in direction X is carried out by jetting ink from nozzles 10 located at nozzle area C among nozzles 10 of recording head 9. The same scanning is repeated until the moment when image recording for the sixth scanning is carried out in the forward direction along the main scanning direction X by jetting ink from nozzles 10 located at nozzle area F, thus, recording for all pixels in one band is completed by scanning in the forward direction for 6 times.

In the meantime, the number of times for scanning necessary for recording one band is not limited to 6 times. Also, the number of times for forming one band may either be more than 6 times or be less than 6 times.

Control section 13 is arranged to control UV irradiation device 11 to irradiate UV for ink jetted on recording medium 2, and to adjust an amount of irradiation of UV, depending on a type of recording medium 2 established by input section 14. Specifically, when a type of a recording medium on which image recording is conducted is established to be fine-quality paper at the input section 14, an amount of irradiation of UV irradiated from each LED 12 is adjusted to be reduced in order from nozzle area A to nozzle area F, which is based on the following reasons.

When one band is formed through plural times of scanning in inkjet recording apparatus 1 employing ink that is cured when it is irradiated by an active energy ray, color transfer of the formed image to the reverse side is affected by an extent of infiltration of ink jetted in the course of the first scanning, because ink jetted in the course of the first scanning becomes the lowermost layer. After that, ink jetted in each scanning is superimposed to be cured on recording medium 2, and ink jetted in the last scanning is superimposed to become the uppermost layer, and this uppermost layer has an influence upon impression of images when the images are viewed. Therefore, glossiness of the image surface and a dot size are affected by the extent of curing of ink jetted in the course of the last scanning.

On the other hand, with respect to the relationship between glossiness of image surface and color transfer to a reverse side of the image on the recording medium and temperature and an amount of irradiation of UV, FIG. 6 (*a*) and FIG. 6 (*b*) show that glossiness on the image surface is increased and color transfer to the reverse side of the image is reduced when temperature and an amount of irradiation of UV are raised, while, glossiness on the image surface is decreased and color transfer to the reverse side of the image is increased when temperature and an amount of irradiation of UV are lowered. Namely, for example, in the case of adjusting color transfer to the reverse side of an image and glossiness of the image surface by adjusting an amount of irradiation of UV, when forming one band on a fine-quality paper through 6 times of scanning, glossiness on the surface is properly maintained under the condition of no color transfer of ink to the reverse side of an image, and high-definition images can be obtained, by controlling each LED 12 corresponding to each of nozzle areas A-F so that an amount of irradiation of UV in $1^{st}$ scanning-$6^{th}$ scanning may be reduced in order, by controlling LED 12 corresponding to nozzle area A, so that an amount of irradiation of UV in the $1^{st}$ scanning is in region H, and by controlling LED 12 corresponding to nozzle area F, so that an amount of irradiation of UV in the $6^{th}$ scanning may become area G. In contrast to the foregoing, if ink is not cured under the condition that an amount of irradiation of UV is adjusted properly in at least the first scanning and the sixth scanning, such as controlling so that an amount of irradiation of UV is in region H from all LEDs 12 corresponding to nozzle areas A-F, or controlling so that an amount of irradiation of UV is in region G from all LEDs 12 corresponding to nozzle areas A-F, color transfer to the reverse side is caused, and appropriate glossiness on the surface cannot be maintained, and high-definition images can be obtained.

As stated above, when one band is formed by plural times of scanning on inkjet recording apparatus 1 employing ink that is cured when it is irradiated by an active energy ray, adjustments for color transfer to the reverse side of an image in image forming and for glossiness are greatly affected by the state of curing ink on the recording medium in the first scanning and the last scanning which are necessary for forming one band, namely, by an amount of irradiation of UV radiated by LED 12. In the control section 13, therefore, when a type of a recording medium on which images are recorded is established to be fine-quality paper on the input section 14, an amount of irradiation of UV irradiated from LED 12 is reduced gradually as the scanning process proceeds, and at least an amount of irradiation of UV irradiated from LED 12 is reduced in the last scanning from the amount of irradiation of UV irradiated from LED 12 in the first scanning.

On the other hand, when a type of a recording medium on which an image is recorded is established to be art paper by input section 14, control section 13 adjusts so that an amount of irradiation of UV irradiated from LED 12 is increased gradually in the order from nozzle area A to nozzle area F.

The reason for the foregoing is that it is not necessary to consider color transfer to the reverse side in the case of art paper because ink hardly sinks into the recording medium from the nature of art paper, and therefore, it is possible to adjust both color transfer to the reverse side and maintenance of glossiness, by adjusting maintenance of glossiness. In addition, it is shown that an area where the glossiness is optimum on art paper is in the region (region I) where temperature and an amount of irradiation of UV are relatively high in FIG. 6 (*a*). Therefore, when forming one band through 6 times of scanning on art paper, for example, if recording medium 2 is irradiated by UV with a control of respective LEDs 12 corresponding respectively to nozzle areas A-F so that an amount of irradiation of UV is increased in the order of the first-sixth scanning operations, with a control of LED 12 corresponding to nozzle area F so that an amount of irradiation of UV in sixth scanning is in range I, glossiness on the surface can be maintained properly under the state of no color transfer to the reverse side of an image, and thereby, high-definition images can be obtained. Therefore, when a type of a recording medium on which an image is recorded is established to be art paper by input section 14, the control section 13 controls to increase an amount of irradiation of UV irradiated by LED 12, in the order as each scanning process proceeds, in the course of plural times of scanning for forming one band, and controls, at least, to increase an amount of irradiation of UV irradiated by LED 12 in the last scanning from an amount of irradiation of UV irradiated by LED 12 in the first scanning.

Next, actions in the present embodiment will be explained as follows.

When image data inputted from an unillustrated external apparatus are sent to inkjet recording apparatus 1, the image data thus sent are stored in RAM of control section 13. Then, when a type of a recording medium used for image recording is selected from input section 14 by a user to be inputted, and when signals to start image recording are inputted, the control section 13 controls recording medium conveyance mechanism 8, and conveys recording medium 2 intermittently from the upstream side to the down stream side in the sub-scanning direction Y sequentially. Further, when the control section 13 controls carriage drive mechanism 6, carriage 5 is caused to scan in the main scanning direction X over the recording medium 2, and the control section 13 controls each recording head 9 to cause ink in predetermined jetted amount to be jetted on a predetermined pixel. Then, when UV is irradiated on ink that is jetted on recording medium 2 from UV irradiation device 11 with a movement of carriage 5, the ink is cured and an image is recorded on recording medium 2.

In this case, when fine-quality paper is inputted at input section 14 as a type of a recording medium used for image recording, the control section 13 adjusts so that an amount of irradiation of UV irradiated from each LED 12 is reduced in the order from nozzle area A to nozzle area F, and an amount of irradiation of UV irradiated on ink on the recording medium 2 at locations corresponding to nozzle area A-nozzle area F is reduced in the order from the nozzle area A to nozzle area F. Then, after single scanning is completed, recording medium 2 is conveyed by an amount equivalent to a nozzle area, and the same recording process is conducted. As a result, an amount of irradiation of UV in the course of curing and fixing of ink is reduced in the order starting from the lower layer on the recording medium 2. As a result, there is recorded an image wherein an amount of irradiation of UV in the course of curing and fixing of ink is reduced in the order starting from the lower layer on the recording medium 2.

On the other hand, when art paper is inputted at input section 14 as a type of a recording medium on which an image is formed, the control section 13 adjusts so that an amount of irradiation of UV irradiated from each LED 12 may be increased in the order from nozzle area A to nozzle area F, and an amount of irradiation of UV irradiated in the order starting from nozzle area A is increased for ink on recording medium 2 at each of locations corresponding to nozzle area A-nozzle area F. Then, after single scanning is completed, recording medium 2 is conveyed by an amount equivalent to a nozzle area, and the same recording process is conducted. As a result, there is recorded an image wherein an amount of irradiation of UV in the course of curing and fixing of ink is increased in the order starting from the lower layer on the recording medium 2.

After that, when image recording is completed, the recording medium 2 is ejected out of the inkjet recording apparatus 1.

In the present embodiment, as stated above, when conducting image recording through plural times of scanning, it is possible to make the state of curing of ink on a recording medium to be in optimum condition, by adjusting an amount of irradiation of UV in the first scanning having an influence on color transfer to the reverse side of an image depending on recording medium 2 and an amount of irradiation of UV in the last scanning having an influence on maintenance of appropriate glossiness on the image surface. Therefore, it is possible to maintain appropriate glossiness on the image surface while preventing color transfer to the reverse side of an image, and to form high-definition images.

Further, by optimizing an amount of irradiation of UV in each scanning process, it is possible to reduce power consumption more and to reduce damage more on a recording medium caused by irradiation of V, compared with a conventional structure where no amount of irradiation of UV is adjusted for each scanning process.

Figure 7:
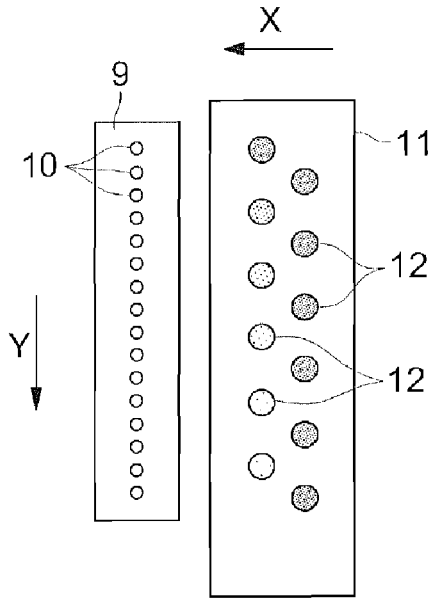
FIG. 7 is a diagram showing another structure of a light source of a UV irradiation device of an inkjet recording apparatus in accordance with the invention.

Incidentally, although an amount of UV irradiated on ink on recording medium 2 is adjusted in a structure wherein LED 12 represents a UV light source, and an amount of irradiation of UV irradiated from LED 12 in the last scanning is reduced from an amount of irradiation of UV irradiated from LED 12 in the first scanning, in the process of plural times of scanning for forming one band, in the present embodiment, it is also possible to arrange a structure wherein there are provided plural LED rows each being arranged to have plural LEDs 12 which are arranged to be row-shaped in the sub-scanning direction Y as shown in FIG. 7, and plural LED rows are arranged to be in parallel with sub-scanning direction Y while changing positions of the plural LED rows in the sub-scanning direction Y, and an amount of irradiation of UV is changed by exchanging LED 12 to be lit.

Figure 8:
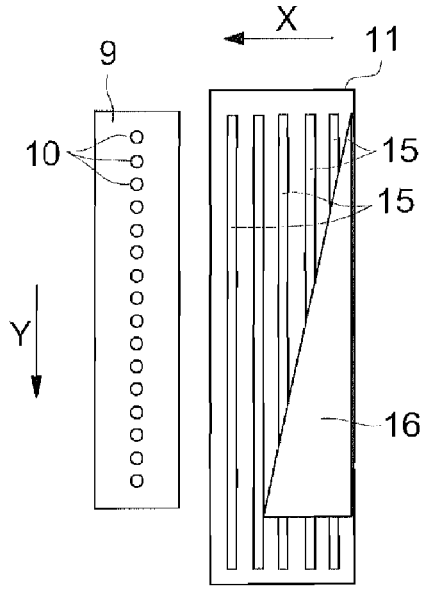
FIG. 8 is a diagram showing still another structure of a light source of a UV irradiation device of an inkjet recording apparatus in accordance with the invention.

Further, it is also possible to employ the structure wherein a plurality of fluorescent tubes 15 are arranged in the direction parallel to the longitudinal direction of recording head 9, in place of LED 12, and shielding member 16 formed to be in a right-angled triangle whose area grows greater toward the downstream side in sub-scanning direction Y (advance direction of recording medium 2) is provided in a way that its one end is located on the upstream side in the direction of arrow X of UV irradiation device 11, as shown in FIG. 8. By constituting the shielding member 16 in the aforesaid way, it is possible to adjust an amount of irradiation of UV so that an amount of irradiation of UV irradiated on ink on recording medium 2 from fluorescent tube 15 is reduced when the recording medium is conveyed. Herein, a more preferable form of the shielding member 16 is represented by a structure wherein no inclination is provided at the upstream end and the downstream end of the aforesaid member in a shape of the right-angled triangle, in the sub-scanning direction Y.

Figure 9:
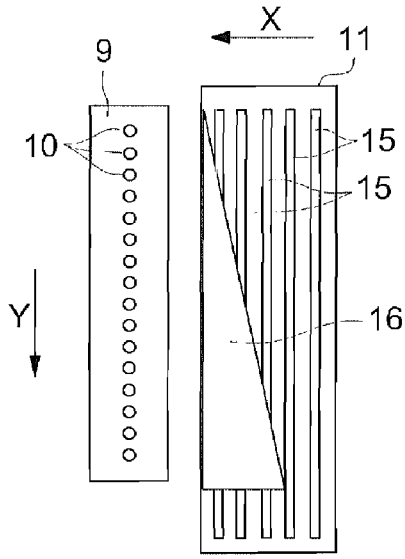
FIG. 9 is a diagram showing yet another structure of a light source of a UV irradiation device of an inkjet recording apparatus in accordance with the invention.

It is also possible to employ a structure wherein the aforesaid shielding member 16 is provided in a way that its one end is located on the downstream side in the direction of arrow X of UV irradiation device 11, as shown in FIG. 9. In this case, it is not only possible to reduce an amount of irradiation of UV irradiated on ink on recording medium 2 from fluorescent tube 15 when the recording medium is conveyed but also possible to delay the timing for irradiating UV from the fluorescent tube 15 and to adjust an amount of irradiation of UV and the irradiation timing for UV. Incidentally, even in this case, a more preferable form of the shielding member 16 is represented by a structure wherein no inclination is provided at the upstream end and the downstream end of the aforesaid member in a shape of the right-angled triangle, in the sub-scanning direction Y.

Further, it is also possible to employ a structure to change an amount of heat energy applied to recording medium 2, in place of adjusting an amount of irradiation of active energy ray irradiated from UV irradiation device 11 and of adjusting its timing.

Figure 10:
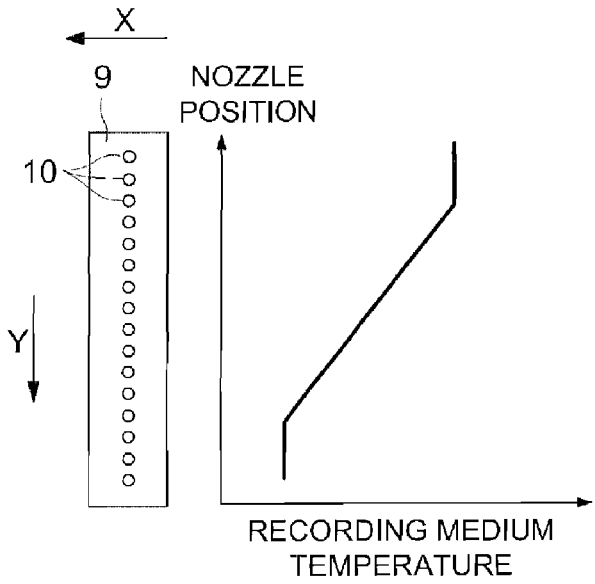
FIG. 10 is a diagram showing still another structure of a light source of a UV irradiation device of an inkjet recording apparatus in accordance with the invention.

In this case, it is possible to make an amount of irradiation of UV irradiated from each LED 12 to be constant, and to provide heaters on platen 3 so that a temperature of ink jetted from each nozzle 10 and impacted on recording medium 2 is adjusted, corresponding to each of nozzle areas A-F, as shown in FIG. 10.

For example, it is possible to arrange a structure wherein, when a type of a recording medium on which an image is recorded is set to fine-quality paper by input section 14 in the case of adjusting color-transfer to the reverse side of an image and glossiness of an image surface, control section 13 adjusts so that a temperature of a heater located at the position corresponding to each of nozzle areas A-F is lowered in the order from nozzle A to nozzle F, in the plural times of scanning process for forming one band, and at least, the control section 13 reduces an amount of heat energy to be generated and applied from the heater in the last scanning from the amount of heat energy to be generated and applied from the heater in the first scanning.

On the other hand, when a type of a recording medium on which an image is recorded is set to art paper by input section 14, it is possible to arrange to increase an amount of heat energy to be generated and applied from the heater in the order from nozzle area A to nozzle area F, and at least, to increase an amount of irradiation of UV irradiated from LED 12 in the last scanning from an amount of irradiation of UV irradiated from LED 12 in the first scanning.

Herein, the controller can adjust the thermal energy application amount from a heater, corresponding to the density of a plurality of provided heaters.

Incidentally, when adjusting an amount of heat energy to be applied, it is preferable to arrange a structure wherein no temperature gradient is provided on the heater arranged at the position where ink jetted from a predetermined nozzle area (for example, an area, in the nozzle area A, at the front side in the traveling direction of recording medium 2 and an area, in the nozzle area F, at the rear side in the traveling direction of recording medium 2) located at each of one end on the front side and on one end of the rear side in the traveling direction of recording medium 2, is impacted.

In addition to the foregoing, a structure to adjust temperature of ink in each nozzle 10 may also be employed, as a structure to change an amount of heat energy to be applied to recording medium 2.

As stated above, in the present embodiment, an amount of irradiation of UV, the timing of irradiating UV and an amount of heat energy to be applied to recording medium 2 (hereinafter referred to as factors including an amount of irradiation of UV) are adjusted so that the state of curing of ink on recording medium 2 becomes the best, in the first and last scanning operations having the greatest influence at least on color transfer to the reverse side of an image and on maintenance of appropriate glossiness on the image surface, in the plural times of scanning processes, whereby, the state of curing ink on recording medium 2 can be made optimum, which makes it possible to obtain high-definition images. Therefore, it is possible to control elements having an influence on quality of image recording such as adjustment of a dot size in addition to color transfer to the reverse side of an image and maintenance of appropriate glossiness on the image surface, provided that the element can be controlled by adjusting factors including an amount of irradiation of UV. In this case, what is needed is to cause the state of curing of ink on recording medium 2 to be optimum by adjusting factors including an amount of irradiation of UV for each scanning.

Figure 11:
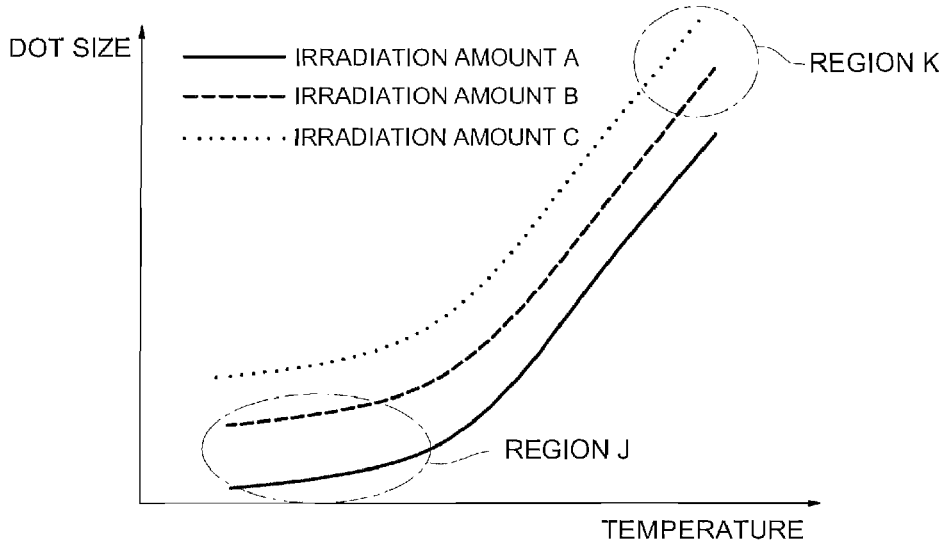
FIG. 11 is a diagram showing the relationship between the size of a dot on an image surface on a recording medium, and the temperature and UV irradiation amount.

FIG. 11 shows tripartite relationship for a dot size on the image surface on recording medium 2, temperature and an amount of irradiation of UV. FIG. 11 shows that an area where a dot size on an image surface of fine-quality paper is optimum is in a region (region J) where temperature and an amount of irradiation of UV are relatively low, and an area where a dot size on an image surface on art paper is in an region (region K) where temperature and UV are relatively high.

Therefore, in the case of adjusting a dot size in particular, when forming one band through 6 times of scanning for fine-quality paper, for example, recording medium 2 is irradiated by UV with a control of respective LEDs 12 corresponding to nozzle areas A-F so that an amount of irradiation of UV in the first-sixth scanning is reduced in this order, and with a control of LED 12 corresponding to nozzle area A so that an amount of irradiation of UV in the first scanning is in region H and also with a control of LED 12 corresponding to nozzle area F so that an amount of irradiation of UV in the sixth scanning is in region J. In such a manner, a dot size on the image surface can be maintained to be appropriate under the condition of no color-transfer to the reverse side of an image, and high-definition images can be obtained. In contrast to this, when forming one band through 6 times of scanning for art paper, recording medium 2 is irradiated by UV with a control of respective LEDs 12 corresponding to nozzle areas A-F so that an amount of irradiation of UV in the first-sixth scanning is increased in this order, and with a control of LED 12 corresponding to nozzle area F so that an amount of irradiation of UV in the sixth scanning is in region K. In such a manner, a dot size on the image surface can be maintained properly under the condition of no color-transfer of color to the reverse side of an image, and high-definition images can be obtained. Incidentally, when adjusting color-transfer to the reverse side of an image and a dot size by adjusting an amount of energy to be applied, it is possible to adjust by conducting the control which is the same as that in adjusting color-transfer to the reverse side of an image and glossiness on the image surface by adjusting the aforesaid amount of energy to be applied.

Further, though the recording medium is established at the input section in the present embodiment, it is also possible to arrange to make the control section 13 adjust an amount of irradiation of UV in accordance with a type of recording medium 2 detected by a sensor by providing the sensor capable of detecting a type of a recording medium at the upstream side in the conveyance direction for recording medium 2, for one of a pair of conveyance rollers 7.

Further, although UV curable ink is used for image recording in the present embodiment, it is also possible to employ ink that is cured when it is irradiated by light other than UV such as, for example, an electron beam, X-ray, visible light and electromagnetic wave such as infrared irradiation, without being limited to the aforesaid ink. In this case, a polymerizing compound that is polymerized and cured with light other than UV and light initiator that initiates polymerization reaction between polymerizing compounds with light other than UV are applied on the ink. When using photocurable ink that is cured with light other than UV, a light source that emits the light needs to be applied in place of a UV light source.

Further, although inkjet recording apparatus 1 having the structure to use ink that is cured when it is irradiated with active energy ray such as UV for image recording has been explained as an example, in the present embodiment, inkjet recording apparatus 1 is not limited to the foregoing, and the invention can also be applied, in the same way, to inkjet recording apparatus 1, for example, having the structure wherein image recording is conducted by using ink that is changed to solid in terms of phase when it is given heat energy to be changed in terms of temperature. In this case, a heating mechanism that heats recording medium 2 is provided in place of UV irradiation device 11.

Further, although there has been explained a structure wherein ink is jetted only when carriage 5 is moved in one direction (main scanning direction X), in the present embodiment, it is also possible to employ a structure wherein ink is jetted for scanning in any direction that is in parallel with the main scanning direction X. When employing the structure of this kind, UV irradiation device 11 is arranged on each of both sides of recording head 9 mounted on carriage 5 as one group.

Further, recording head 9 used for inkjet recording apparatus 1 of the invention can be either of an on demand type or of a continuous type. As a jetting method, it is possible to use any one among, for example, an electric-mechanical conversion type (for example, single-cavity type, double-cavity type, a bender type, a piston type, a share mode type and a shared wall type), an electric-thermal conversion type (for example, a thermal inject type and a bubble-jet (registered trademark) type), an electrostatic absorbing type (for example, an electric field control type, a slit-jet type) and a discharge type (for example, a spark-jet type).

In addition to the foregoing, the invention can naturally be modified properly, without being limited to the embodiment above.

Second Embodiment

Next, the Second Embodiment of the inkjet recording apparatus in accordance with the invention will be explained, referring to FIG. 12. Incidentally, those explained below are points different from those in the First Embodiment.

Figure 12:
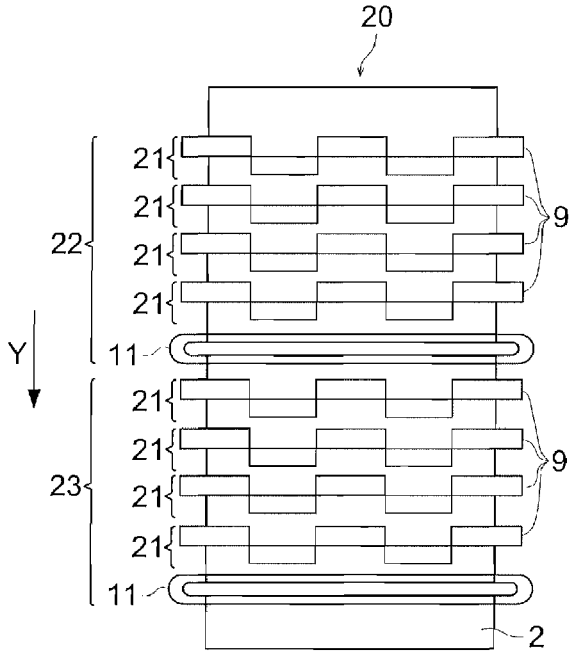
FIG. 12 is a top view showing a structure of a main body of an inkjet recording apparatus in a second embodiment of the present invention.

As shown in FIG. 12, inkjet recording apparatus 20 in the present embodiment is an inkjet recording apparatus of a line type.

In the inkjet recording apparatus 1 in the first embodiment, one band is formed through 6 times of scanning, namely, through 6 times of UV irradiations. In the inkjet recording apparatus of a line type 20 in the present embodiment, one band is formed through twice UV irradiations. In the meantime, the number of times of UV irradiations necessary for forming one band is not limited in particular if it is plural times such as 3 times or 4 times without being limited to 2 times.

On the upper portion of platen 3 in this inkjet recording apparatus 20, there are provided head units 21 each jetting ink for each of Y, M, C and K in this order in the conveyance direction of recording medium to cover the entire width of recording medium 2, and each head unit 21 is formed by plural recording heads 9 arranged in a staggered way in the width direction of recording medium 2 on which a nozzle ray is formed in the width direction of recording medium 2.

At the downstream side of the head unit 21 arranged at the most downstream side in the conveyance direction for recording medium 2, there is formed UV irradiation device 11 having a length corresponding to that of head unit 21.

One set of recording head mechanism 22 is constructed with these plural head units 21 and a UV irradiation device 11 necessary for a single time of irradiation of UV, and recording head mechanism 23 having the same structure is provided at the further downstream side of the recording head mechanism 22 in the conveyance direction for recording medium 2, and thereby, one band can be formed through two times of UV irradiations. Namely, UV irradiation device 11 in the recording head mechanism 22 means the first irradiation of UV for ink jetted on recording medium 2, while, UV irradiation device 11 in the recording head mechanism 23 means the second irradiation of UV for ink jetted on recording medium 2.

Herein, amounts of irradiation of UV of the UV irradiation devices 11 arranged in the recording head mechanism 22 and the recording head mechanism 23 are adjusted in accordance with a type of recording medium 2 established by input section 14. Specifically, when a type of a recording medium on which an image is recorded is set to fine-quality paper, UV emitted from recording head mechanism 23 is adjusted to be reduced from an amount of irradiation of UV emitted from recording head mechanism 22. It is arranged to control so that UV is irradiated under the condition that an amount of irradiation of UV emitted from recording head mechanism 22 is made to be in region H and an amount of irradiation of UV emitted from recording head mechanism 23 is made to be in region G, which is especially preferable.

On the other hand, when a type of a recording medium on which an image is recorded is set to art paper, UV emitted from recording head mechanism 23 is adjusted to be increased for an amount of irradiation of UV emitted from recording head mechanism 22. It is arranged to control so that UV is irradiated under the condition that an amount of irradiation of UV emitted from recording head mechanism 23 be made to be in region I, which is especially preferable.

Owing to the structure stated above, when image data inputted from an unillustrated outer equipment are sent to inkjet recording apparatus 1, the image data thus sent are stored in RAM of control section 13. Then, when a type of a recording medium used for image recording is selected and inputted by a user through input section 14, and when signals to start image recording are inputted, the control section controls a conveyance mechanism for a recording medium to convey recording medium 2 in order to the downstream side from the upstream side in the sub-scanning direction Y, and control section 13 controls each recording head 9 to jet a predetermined amount of ink to a predetermined pixel. Subsequently, with the movement of the recording medium 2, UV is irradiated on ink jetted on recording medium 2 from UV irradiation device 11, whereby, ink is cured and fixed, and an image is recorded on the recording medium 2.

Herein, when fine-quality paper is inputted at the input section as a type of a recording medium used for image recording, the control section adjusts an amount of irradiation of UV irradiated from UV irradiation device 11 in recording head mechanisms 22 and 23, and an amount of irradiation of UV for ink on recording medium 2 is reduced with conveyance of recording medium 2.

On the other hand, when art paper is inputted at the input section as a type of a recording medium used for image recording, the control section adjusts an amount of irradiation of UV irradiated from UV irradiation device 11 in recording head mechanisms 22 and 23, and an amount of irradiation of UV for ink on recording medium 2 is increased with conveyance of recording medium 2.

After the image recording is completed thereafter, the recording medium 2 is ejected out of inkjet recording apparatus 20.

In the present embodiment, when conducting image recording through a process of plural times of irradiation of UV, an amount of irradiation of UV in the course of the first scanning having an influence on color-transfer to the reverse side of an image, and an amount of irradiation of UV in the course of the last scanning having an influence on maintenance of appropriate glossiness on the image surface, are adjusted depending on recording medium 2, whereby, the state of curing of ink on the recording medium 2 can be made to be in the optimum, which makes it possible to keep the appropriate glossiness on the image surface while preventing color-transfer to the reverse side of an image, thus, high-definition images can be formed.

What is claimed is:

1. An inkjet recording apparatus, comprising:

a recording head having a plurality of nozzles that jet ink onto a recording medium, wherein the ink is cured by irradiating active energy ray thereon and/or applying thermal energy thereto;

an ink curing device for curing the ink jetted onto the recording medium, having an active energy ray irradiating unit and/or thermal energy applying unit; and a controller that performs image recording by repeating a recording process for plural times to form a single band in which process the recording head jets ink onto the recording medium and then the active energy ray irradiation and/or thermal energy application is performed, wherein, for each said single band, the controller controls the active energy ray irradiating unit and/or thermal energy applying unit such as to decrease or increase, depending on a type of the recording medium, throughout a last recording process of the repeated times of the recording process, from a first recording process of the repeated times of the recording process, at least one of operating parameters which are an active energy ray irradiation amount, active energy ray irradiation duration, and thermal energy application amount.

2. The inkjet recording apparatus of claim 1, further comprising a moving mechanism that relatively moves the recording head and the recording medium, wherein the controller divides a nozzle area, the nozzles being arranged in the nozzle area, into a number of times of scanning necessary to form a single band, and controls the recording head to scan for the number of times dividing the nozzle area, so as to form a single band.

3. The inkjet recording apparatus of claim 1, wherein the controller changes at least one of the active energy ray irradiation amount, active energy ray irradiation duration, and thermal energy application amount, corresponding to a sort of the recording medium.

4. The inkjet recording apparatus of claim 1, wherein the controller changes at least one of the active energy ray irradiation amount, active energy ray irradiation duration, and thermal energy application amount, so as to adjust a penetration amount of ink on the recording medium.

5. The inkjet recording apparatus of claim 1, wherein the controller changes at least one of the active energy ray irradiation amount, active energy ray irradiation duration, and thermal energy application amount, so as to adjust a size of a dot of ink on the recording medium.

6. The inkjet recording apparatus of claim 1, wherein the controller changes at least one of the active energy ray irradiation amount, active energy ray irradiation duration, and thermal energy application amount, so as to adjust glossiness of ink on the recording medium.

7. The inkjet recording apparatus of claim 1, wherein the ink curing device has a plurality of the active energy ray irradiating units;

and wherein the controller adjusts the active energy ray irradiation amount, by controlling an active energy ray irradiation amount to be irradiated from each active energy ray irradiating unit and/or a number of the active energy ray irradiating units to be used.

8. The inkjet recording apparatus of claim 1, wherein a shielding member for shielding active energy ray irradiated onto the recording medium is provided between the active energy ray irradiating unit and the recording medium;

and wherein the controller adjusts the active energy ray irradiation amount and the active energy ray irradiation duration, corresponding to a range shielded by the shielding member.

9. The inkjet recording apparatus of claim 1, further comprising a platen that supports the recording medium during recording, wherein the thermal energy applying unit is provided with a plurality of heaters on the platen;

and wherein the controller adjusts the thermal energy application amount, corresponding to a density of the plurality of heaters.

10. An inkjet recording method, comprising the steps of:

jetting ink onto a recording medium from a plurality of nozzles of a recording head, wherein the ink is cured by irradiating active energy ray thereon and/or applying thermal energy thereto; and curing the ink jetted onto the recording medium by irradiating active energy ray thereon and/or applying thermal energy thereto, wherein the method performs image recording by repeating a recording process for plural times to form a single band in which process ink is jetted from the recording head onto the recording medium and then the energy ray irradiation and/or thermal energy application is performed;

and wherein the method performs control, for each said single band, of the active energy ray irradiation unit and/or thermal energy applying unit such as to decrease or increase, depending on a type of recording medium, throughout a last recording process of the repeated times of the recording process from a first recording process of the repeated times of the recording process, at least one of operating parameters which are an active energy irradiation amount, active energy irradiation duration and thermal energy application amount.

* * * * *